United States Patent [19]

Rabas

[11] 4,330,955

[45] May 25, 1982

[54] POINT OF PURCHASE DISPLAY DEVICE

[75] Inventor: Kenneth J. Rabas, Waukesha, Wis.

[73] Assignee: DCI Marketing, Milwaukee, Wis.

[21] Appl. No.: 217,951

[22] Filed: Dec. 17, 1980

[51] Int. Cl.[3] ..... G09F 11/00

[52] U.S. Cl. ..... 40/489; 40/447

[58] Field of Search ..... 40/10 R, 312, 605, 489, 40/447, 584

[56] References Cited

U.S. PATENT DOCUMENTS

| | | | |
|---|---|---|---|
| 1,544,214 | 6/1925 | Bruns | 40/312 |
| 2,644,259 | 7/1953 | Beadle | 40/312 |
| 3,362,093 | 1/1968 | Joselevich | 40/605 |
| 3,418,738 | 12/1968 | Goodman | 40/605 |

*Primary Examiner*—Gene Mancene

*Assistant Examiner*—Wenceslao J. Contreras

*Attorney, Agent, or Firm*—Michael, Best & Friedrich

[57] ABSTRACT

The invention provides an attractive and versatile point of purchase display device comprising a collapsible body member having an open end portion and an end member which includes oppositely facing convex and concave surfaces. The body member, as well as both convex and concave surfaces of the end member, can be suitably inscribed with desired advertising indicia. The end member is adapted to fit over the open end portion of the body member when it is in a non-collapsed position with either its concave or convex surfaces exposed to customer view. When so positioned, the end member rigidly maintains the body member in its non-collapsed position for use.

4 Claims, 6 Drawing Figures

POINT OF PURCHASE DISPLAY DEVICE

BACKGROUND OF THE INVENTION

This invention relates generally to point of purchase display devices.

SUMMARY OF THE INVENTION

The invention provides a point of purchase display device comprising a body member having an open end portion and an end member which includes oppositely facing convex and concave surfaces. The body member and both convex and concave surfaces of the end member can all be suitably inscribed with a desired advertising design or message. The end member is adapted to fit over the open end portion of the body member with a selected one of its concave and convex surfaces exposed to customer view. Thus, the display effect of the device can be quickly and simply altered. An eyecatching, versatile point of purchase display is thus provided.

In one embodiment, the body member includes sidewalls which are hingedly attached together so as to be collapsable upon themselves for transportation and storage. The end member serves to rigidly maintain the body member in a non-collapsed condition so that, in use, the device can be table-mounted or suspended from the ceiling.

GENERAL DESCRIPTION

Figures 1, 2, 3, 4, 5, 6:
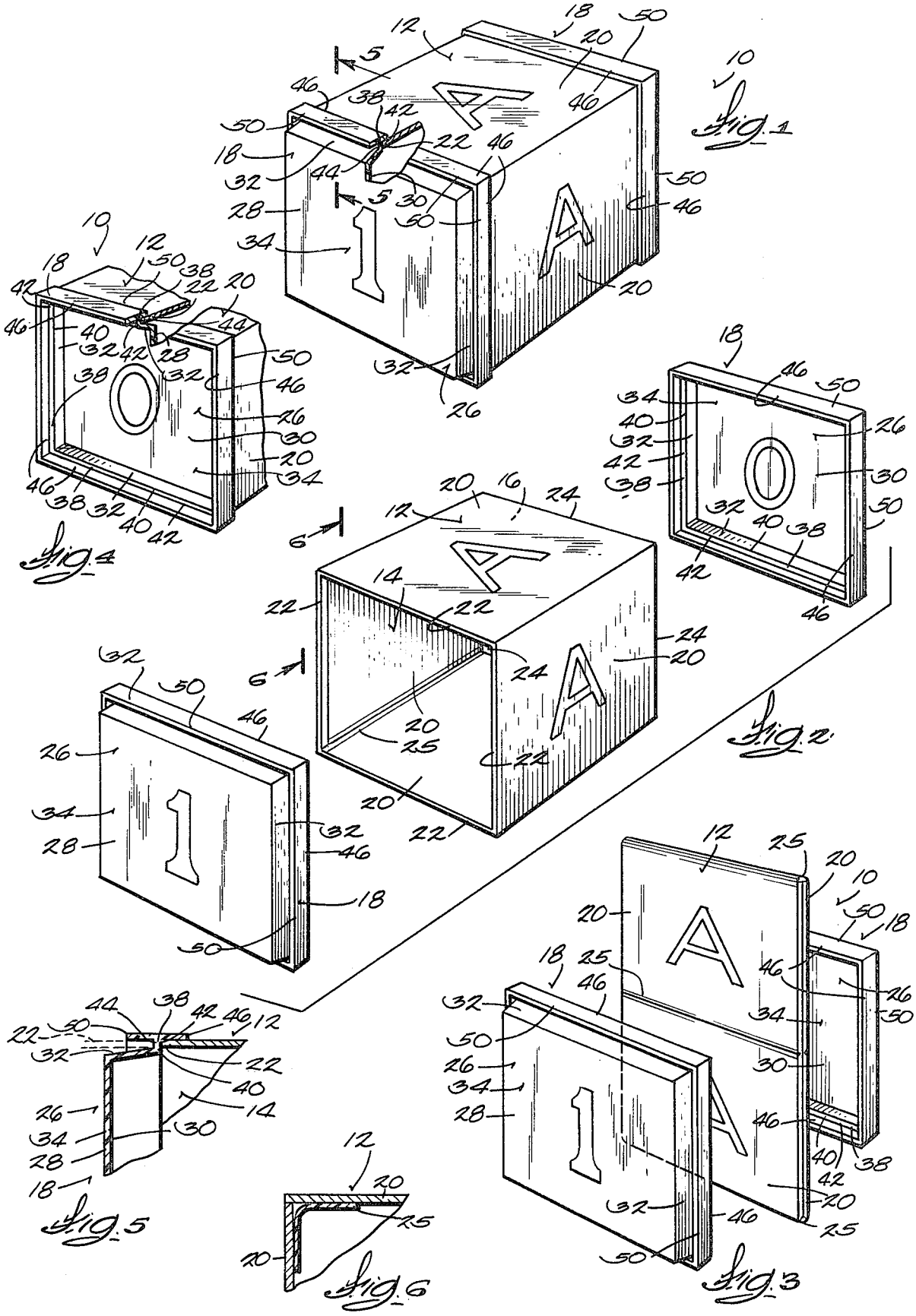
FIG. 1 is a perspective view, with parts broken away and in section, of a point of purchase display device which embodies the features of the invention and with the convex surface of each end member exposed to view.
FIG. 2 is an exploded perspective view of the display device shown in FIG. 1, with the body member shown in an open, non-collapsed position.
FIG. 3 is an exploded perspective view of the display device similar to FIG. 2, except the body member is shown in a collapsed position.
FIG. 4 is a fragmentary perspective view, with parts broken away and in section, of the display device shown in FIG. 1, except that the concave surface of one end member is now exposed to view.
FIG. 5 is a section view of an end member of the display device generally taken along line 5—5 of FIG. 1.
FIG. 6 is a section view of the body member of the display device taken generally along line 6—6 in FIG. 2.

Shown in the drawings is a display device 10 suited for customer view at point of purchase and similar applications. The device 10 includes a body 12 having oppositely facing open end portions 14 and 16 (see FIG. 2) and at least one end member 18 which is adapted to cover either end portion 14 or 16. Preferably, as is shown in FIG. 1, two end members 18 are provided to simultaneously cover both end portions 14 and 16.

In the illustrated embodiment (as is best shown in FIG. 2), the body 12 is formed by four adjacently spaced side panels 20, collectively forming a rectilinear shape for the body 12. In the particular embodiment illustrated, this rectilinear shape is generally cubical. However, other shapes, rectilinear or non-rectilinear, can be utilized.

The side panels 20 terminate in oppositely spaced edges 22 and 24 which peripherally bound the respective open end portions 14 and 16 of the body 12. Due to the generally cubical configuration of the side panels 20, these open end portions 14 and 16 are generally square in shape.

The side panels 20 can be constructed of various sturdy, lightweight materials, such as paper or plastic, or a combination of the two. Any or all of the panels 20 can be opaque or, if desired, translucent so that a light can be mounted within the body 12 and heighten the visual effect of the display device 10. Appropriate advertising designs can be printed, pasted, embossed or the like on the panels 20.

As best shown in FIGS. 2 and 6, in the preferred embodiment, the side panels 20 are hingedly attached together, such as by plastic strips 25 or the like which are glued or otherwise affixed to adjacent panels 20. By virtue of this arrangement, the side panels 20 can be collapsed upon themselves (as shown in FIG. 3) to facilitate storage or transportation of the body 12. In this arrangement, and as will be described in greater detail later herein, the end members 18 serve to rigidly maintain the body 12 in its non-collapsed or open position (as shown in FIG. 1) when in use.

As can best be seen in FIGS. 2 and 5, each of the end members 18 includes a main or mid portion 26 having a generally convex or outwardly projecting surface 28 and an oppositely facing generally concave or inwardly projecting surface 30. While various constructions are possible, in the illustrated embodiment, the main portion 26 includes spaced upright sidewalls 32 and a top wall 34 which extends from the upright sidewalls 32. The oppositely facing convex and concave surfaces 28 and 30 are thus formed.

Like the body 12, each end member 18 can be constructed of various sturdy, lightweight materials, such as paper or plastic, and be opaque or translucent, according to the particular display effect desired. Also, the oppositely facing convex and concave surfaces 28 and 30 can each bear advertising indicia.

The end members 18 can be fitted upon the open end portions 14 and 16 of the body 12 with either their convex or concave surface 28 or 30 exposed to customer view. More particularly, each end member 18 includes a lip portion 38 (as best shown in FIG. 5) which extends at a right angle outwardly from the lower peripheral edge 40 of each sidewall 32. The lip portion 38 includes a first surface area 42 which faces in the same direction as the concave surface 30 and a second surface area 44 which faces in the same direction as the convex surface 28. As is shown in FIG. 1 and in solid lines in FIG. 5, the first surface area 42 overlies the edges 22 and 24, locating the end member 18 over the respective open end portion 14 or 16 with the convex surface 28 exposed to customer view. Alternately, as shown in FIG. 4 and in phantom lines in FIG. 5, the second surface area 44 can also overlie the edges 22 and 24, thereby locating the end member 18 over the respective open end portion 14 or 16 with the concave surface 30 exposed to customer view.

A first skirt 46 extends at generally a right angle from the first lip surface 42. The first skirt 46 peripherally surrounds a portion of the side panels 20 adjacent to the open end portions 14 or 16 when the first surface area 42 of the lip portion 38 is engaged thereon (as shown in FIG. 1 and in solid lines in FIG. 5), thereby rigidly maintaining the body 12 in an open, or non-collapsed, position.

In like fashion, a second skirt 50 extends at generally a right angle from the second lip surface 44 and is generally coplanar with the first skirt 46. The second skirt 50, like the first skirt 46, peripherally surrounds a portion of the side panels 20 adjacent to the open end portion 14 and 16 when the second lip surface 44 is engaged thereon (as shown in FIG. 4 and in phantom lines in FIG. 5), and, like the first skirt 46, serves to rigidly maintain the body 12 in an open, or non-collapsed, position.

Thus, when at least one of the end members 18 is in position on one of the end portions 16 or 18 of the body 12 with either the convex or concave surfaces 28 or 30 exposed to customer view, the device 10 is self-supporting and can rest in an upright or lengthwise position atop a table or display counter. The device 10 can also be suspended lengthwise from the ceiling, if desired.

In one possible use (not shown), the outwardly exposed convex surface 28 can bear a clock face, and a clock mechanism can be suitably mounted within the concave surface 30.

As is apparent from the foregoing, the device 10 provides an eyecatching, versatile point of purchase display.

Various of the features of the invention are set forth in the following claims.

I claim:

1. A display device comprising a body having peripheral edges defining an open end portion, and an end member including a main portion having an outer surface and an oppositely facing inner surface, and a lip means extending perpendicularly outwardly from said main portion and defining a first surface area engageable on all said peripheral edges of said body to position said end member over said open end portion with said outer surface exposed to customer view and also defining an oppositely facing second surface area engageable on all said peripheral edges of said body to position said end member over said open end portion with said inner surface exposed to customer view so that said end member can be positioned in engagement with said peripheral edges of said body with said outer surface being exposed to customer view or alternatively with said inner surface being exposed to customer view.

2. A display device according to claim 1 wherein said lip means and said first and second surface areas thereof extend around the periphery of said body and said body includes a plurality of adjacent side panels hingedly attached to each other for movement between a collapsed position, in which said adjacently located side panels overlie each other, and an open position, in which said adjacently located side panels are located at generally positive angles to each other, and wherein said end member is engageable on and around said peripheral edges of said body over said open end portion when said body side panels are in said open position.

3. A display device according to claim 2 and further including a first skirt member extending from said lip means at generally a right angle from said first surface area thereof and peripherally surrounding said body side panels adjacent to said open end portion when said first surface area of said lip is engaged on said peripheral edges to maintain said body side panels in said open position, and a second skirt member extending from said lip means at generally a right angle from said second surface area thereof and peripherally surrounding said body side panels adjacent to said open end portion when said second surface area of said lip is engaged on said peripheral edges to maintain said body side panels in said open position.

4. A display device according to claim 1 wherein the outer surface is generally outwardly convex and the inner surface is generally inwardly concave.

* * * * *